United States Patent [19]

Gano et al.

[11] Patent Number: 4,831,856

[45] Date of Patent: May 23, 1989

[54] HEAT EXCHANGER COIL BENDING APPARATUS AND METHOD

[75] Inventors: Richard E. Gano; David A. Gano, both of Salem; Heinz-Siegfried Garbe, North Canton, all of Ohio

[73] Assignee: Tru-Cut Die Corp., Salem, Ohio

[21] Appl. No.: 72,570

[22] Filed: Jul. 13, 1987

[51] Int. Cl.[4] ..... B21D 7/04

[52] U.S. Cl. ..... 72/149

[58] Field of Search ..... 29/157.3 A, 157.3 B; 72/149, 154, 156, 157, 158, 159, 310

[56] References Cited

U.S. PATENT DOCUMENTS

| | | | |
|---|---|---|---|
| 2,810,422 | 10/1957 | Bower | 72/154 X |
| 3,443,296 | 5/1969 | Clausing | 29/157.3 |
| 3,468,009 | 9/1969 | Clausing | 29/157.3 |
| 3,545,247 | 12/1970 | Fazzani | 72/310 |
| 3,597,956 | 8/1971 | Clausing | 29/157.3 |
| 3,831,420 | 8/1974 | Byzov et al. | 29/157.3 |
| 3,899,908 | 8/1975 | Somov et al. | 72/310 X |
| 4,063,441 | 12/1977 | Eaton | 72/154 X |
| 4,173,998 | 11/1979 | Jahoda | 29/157.3 |
| 4,727,737 | 3/1988 | Bryant | 72/153 |

*Primary Examiner*—E. Michael Combs

*Attorney, Agent, or Firm*—Sandy Co. Michael

[57] ABSTRACT

An apparatus for bending single or multiple stacked flat sections of finned heat exchanger coil into a predetermined configuration having one, two or three generally 90 degree bends. The coil is moved along a support table to a bending station by a gripper mechanism engaged with the rear end of the coil. A portion of the coil forward of the position to be bent is clamped against an anvil by a clamping pad. A hold-down assembly prevents another portion of the coil rearward of the bend portion from raising off the support table as the anvil and clamping pad are rotated by a supporting spindle to bend the coil to the desired angle. The gripper mechanism is accelerated linearly forwardly in coordinated movement with the rotational acceleration of the spindle to prevent distortion of the coil fins by crowding material into the bend. The gripper mechanism is moved linearly along the support table by a controlled ball screw drive mechanism. The invention also resides in the method of bending the coil by the coordinated accelerated movement of the gripper mechanism with the rotational accelerated movement of the spindle containing the anvil and clamping pad to crowd material into the bend during the bending step.

22 Claims, 8 Drawing Sheets

HEAT EXCHANGER COIL BENDING APPARATUS AND METHOD

TECHNICAL FIELD

The invention relates to an apparatus and method for bending a straight section of finned heat exchanger coil into a configuration having one or more generally 90° bends. More particularly the invention relates to an apparatus and method for accelerating the linear movement of the coil in coordination with the rotation acceleration of the coil area being bent to crowd additional material into the bend area to reduce distortion of the fins in the bend area.

BACKGROUND ART

Heat exchanger coils of the type commonly used in air conditioning units for both domestic and commercial applications are formed by a plurality of parallel tubes having a number of fins mounted thereon for dissipating the heat contained in the fluid moving through the tubes. The size and density of the fins principally determine the rate of heat dissipation provided by the coil. In order to increase the effectiveness of coil, the fins are lanced to form tabs in the individual fins which increases turbulence of the cooling air and correspondingly increases the heat loss. However, the lancing of fins results in a weakened coil. These lanced fins are referred to as "enhanced fins" and enables less fins to be used due to the increased efficiency, but provides a fin of reduced strength providing structural problems, especially during the bending of the coil into a desired configuration.

The bending of the coil which is constructed in a linear sheet is necessary to enable the coil to be fitted into a housing to provide a compact unit as possible. These straight, flat coils usually are formed with one, two or three generally 90° bends to form an "L"-shaped, "U"-shaped or box-shaped coil for installation in the housing of the air conditioning unit.

Existing bending apparatus has been found to be inefficient to form the bend on such enchanced finned coils since the fins in the area of the bends are distorted, especially on the inside of the bends which stops the air flow through the corner of the coil reducing the cooling efficiency of the coil. Therefore, the need exists for an improved coil bending apparatus and method for bending enhanced finned coils without damaging the fins in the bend area.

Examples of known prior art coil bending apparatus and methods are shown in U.S. Pat. Nos. 3,443,296 and 3,597,956 in which the coil is bent by a pair of pivotally mounted grippers located on opposite side of the bend area. U.S. Pat. No. 4,173,998 discloses another coil forming method and apparatus in which the bending action is compensated for during the initial construction of the coil so that the coil after being bent, will have the desired bend without damaging the fins.

U.S. Pat. No. 3,831,420 is believed to be one of the most pertinent prior art with respect to our invention in that it discloses a method of bending a heat exchanger coil in which an axial force is applied to the rear of the coil to bring the material of the tubes to a critical state just preceding the loss of longitudinal stability of the tubes as the tube is bent by moving it along a surface which has the final shape into which the coil is to be bent.

Another known coil bending apparatus and method of which the present invention is an improvement utilizes a flat, horizontal table along which the exchanger coil is moved by pneumatic cylinders for advancing a forward end of the coil at a constant speed onto an anvil where it is clamped by a clamping pad, after which the clamping pad and anvil which are mounted on a spindle, are rotated through a predetermined angle for imparting the desired bend angle on the coil. Another portion of the coil located just rearwardly of the anvil and clamping pad prevents the upward movement of the coil from the support table during the rotation of the anvil and clamping pad. Although this apparatus and method forms satisfactory bends for many finned coils, it has not proved entirely satisfactory for bending enhanced finned coils due to the less structural strength provided by the lanced fins.

Therefore, the need exists for an improved heat exchanger coil bending apparatus and method which eliminates the difficulties present in existing apparatus and methods to provide a bend in a heat exchanger coil, especially a coil having enhanced or lanced fins.

DISCLOSURE OF THE INVENTION

Objections of the invention include providing an improved apparatus and method for bending heat exchanger coils and in particular coils having enhanced fins which provides increased cooling efficiency, but has less structural strength than prior finned coil constructions, and in which the resultant bend reduces materially the distortion or crimping of the ends of the fins which are located inside of the bend area or radius.

Another objective of the invention is to provide such an improved apparatus and method in which the "U"-shaped rear ends or tube hairpins which extend beyond the coil header are gripped by a gripper mechanism having an accurately controlled drive means for advancing the coil linearly along a horizontal support table toward a bending station; and in which a portion of the coil located just forward of the bending station is clamped against an anvil at the bending station with another portion located just rearwardly of the bending station is restrained by a hold-down mechanism preventing upward movement during formation of the bend upon rotation of the clamping pad and anvil which are mounted on a spindle.

A still further objective of the invention is to provide such an improved apparatus and method in which the linear speed of the gripper mechanism is accelerated in coordination with the accelerated rotational speed of the spindle to crowd material into the bend during the formation thereof which reduces considerably the deformation of the fins inside the bend radius as heretofore occurred with prior apparatus and methods; and in which the rate of linear acceleration is greater than the rate of rotational acceleration of the spindle and attached clamping pad and anvil to achieve the crowding of the additional coil material into the bend area.

A further objective of the invention is to provide such an improved apparatus and method which can form multiple bends in the coil of various bend radii by replacement of the anvil with different sized sections; in which the support table and hold-down assembly is provided with roller-mounted belts which permit free and smooth movement of the coil along the table without damaging the fins; and in which the movement of the clamping pad and hold-down assembly is by pneumatic or hydraulic pressurized cylinders.

Another objective of the invention is to provide such an apparatus and method in which the drive mechanism for the gripper assembly is by a precision ball screw and associated servo-drive motor the movement of which is coordinated with the rotational movement of the spindle by a programmable computer enabling the apparatus to be programmed for various bends, bent angles and radii and coil configurations whereby the apparatus can be used with coils having different densities and sizes of fins by simply changing the program and thereby the controlled, accelerated movement of the gripper mechanism and bend-forming spindle.

Another objective is to provide such an improved apparatus and method in which the gripper and spindle mechanisms are controlled in their accelerated movement in unison so as to accelerate together at different speeds but coordinated to arrive at final end points at the same time to achieve the improved bend in the coil.

These objectives and advantages of the invention are obtained by the improved apparatus for bending heat exchanger coils to a predetermined angle at a bending station, the general nature of which may be stated as including table means for supporting a coil during linear movement of said coil toward the bending station; gripper means engagable with the coil for advancing said coil linearly forwardly along the table means; hold-down means engagable with the coil adjacent the bending station for maintaining a portion of the coil located rearward of the bending station against the table means during bending of a forward portion of said coil; bending means engagable with the coil at the bending station for bending the coil to a predetermined angle; first drive means for rotating the bending means through a predetermined angle for bending the coil; and second drive means engagable with the gripper means for accelerating the gripper means and engaged coils linearly in coordination with the rotation of the bending means during bending of the coil by said bending means to reduce distortion of the coil by crowding coil material into the bend.

These objectives and advantages are obtained further by the improved method of the invention for bending a heat exchanger coil to a predetermined angle, the general nature of which may be stated as including the steps of advancing the coil generally horizontally linearly along a support surface toward a bend station; clamping a first portion of the coil against an anvil immediately adjacent to and forward of a second portion of the coil to be bent at the bending station; holding a third portion of the coil rearward of the first portion from upward movement from the support surface; rotating the anvil through a predetermined angle while the first portion of the coil remains clamped against the anvil and the third portion held against upward movement to bend the second portion of the coil; and accelerating the linear advancement of the coil along the support surface in coordination with the rotation of the anvil to prevent distortion to fins of the coil by crowding more coil material into the bend during the formation thereof.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
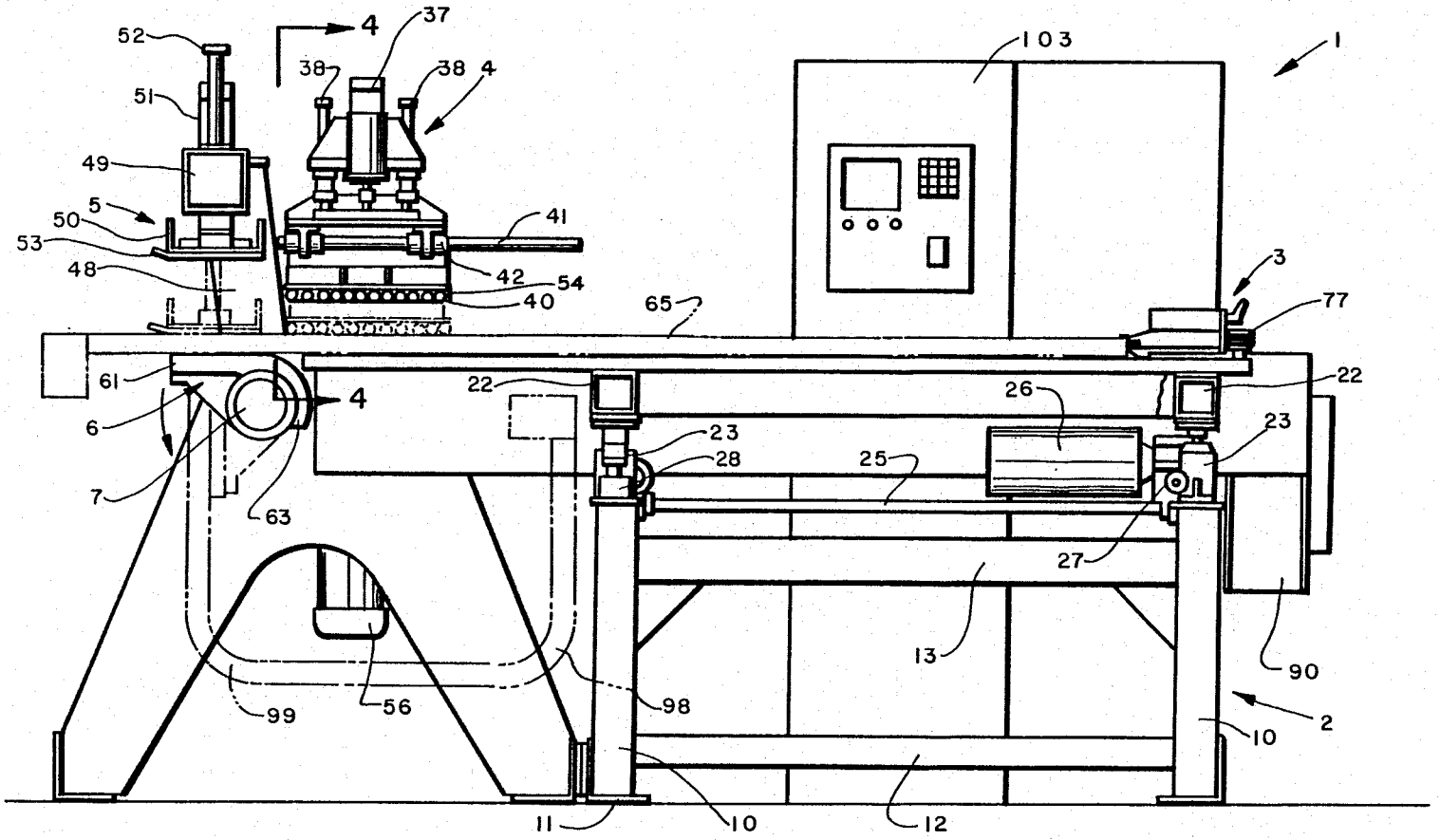
FIG. 1 is a side elevational view of the improved heat exchanger coil bending apparatus of the invention with a coil being shown mounted thereon prior to imparting a bend therein.
Figure 2:
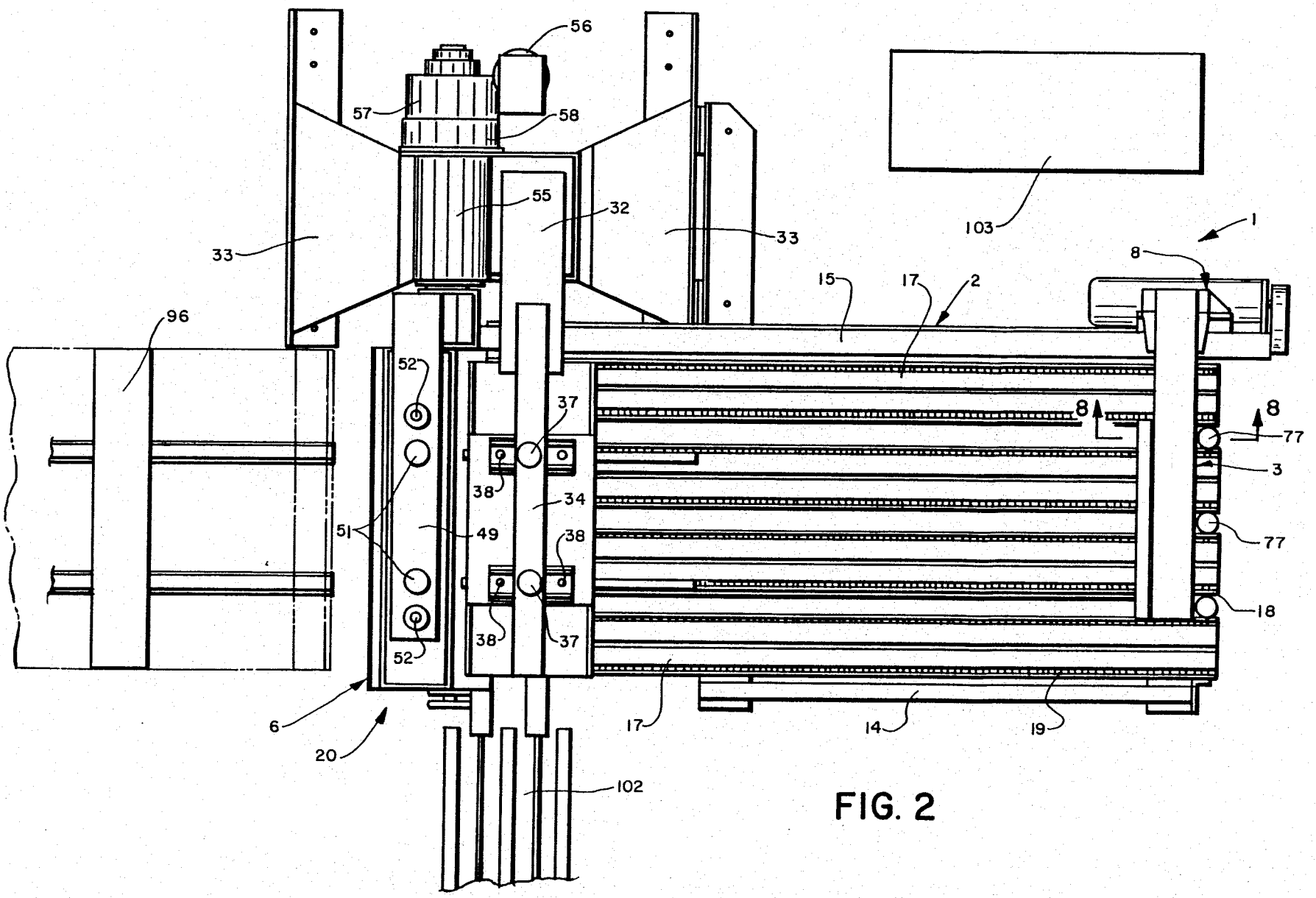
FIG. 2 is a top plan view of the apparatus of FIG. 1 with the coil being removed therefrom.

The improved coil bending apparatus is indicated generally at 1 and is shown particularly in FIGS. 1 and 2. Apparatus 1 includes as its main general components a support table 2, a coil gripper assembly 3, a hold-down assembly 4, a clamping pad assembly 5 and an anvil assembly 6. Clamping pad assembly 5 and anvil 6 are both mounted on a spindle 7 and a gripper drive assembly indicated generally at 8, is operatively connected to gripper assembly 3 for advancing it linearly along support table 2.

Support table 2 includes a plurality of vertical frame members 10 which extend upwardly from "L"-shaped base angles 11 with lower and upper horizontal channels 12 and 13 extending between members 10. A rectangular shaped table edge channel 14 extends longitudinally along one side of the support table and a "U"-shaped mounting channel 15 (FIGS. 2 and 6) extends longitudinally along the other side of the table. A plurality of longitudinally extending conveyor belts 17 are mounted within individual box-like frame channels 18 by a plurality of free turning rollers 19. Conveyor belts 17 extends generally from the gripper end (right-hand end of FIG. 2) to a bend station indicated generally at 20, located at the front end of the apparatus (left-hand end of FIGS. 1 and 2).

Figure 6:
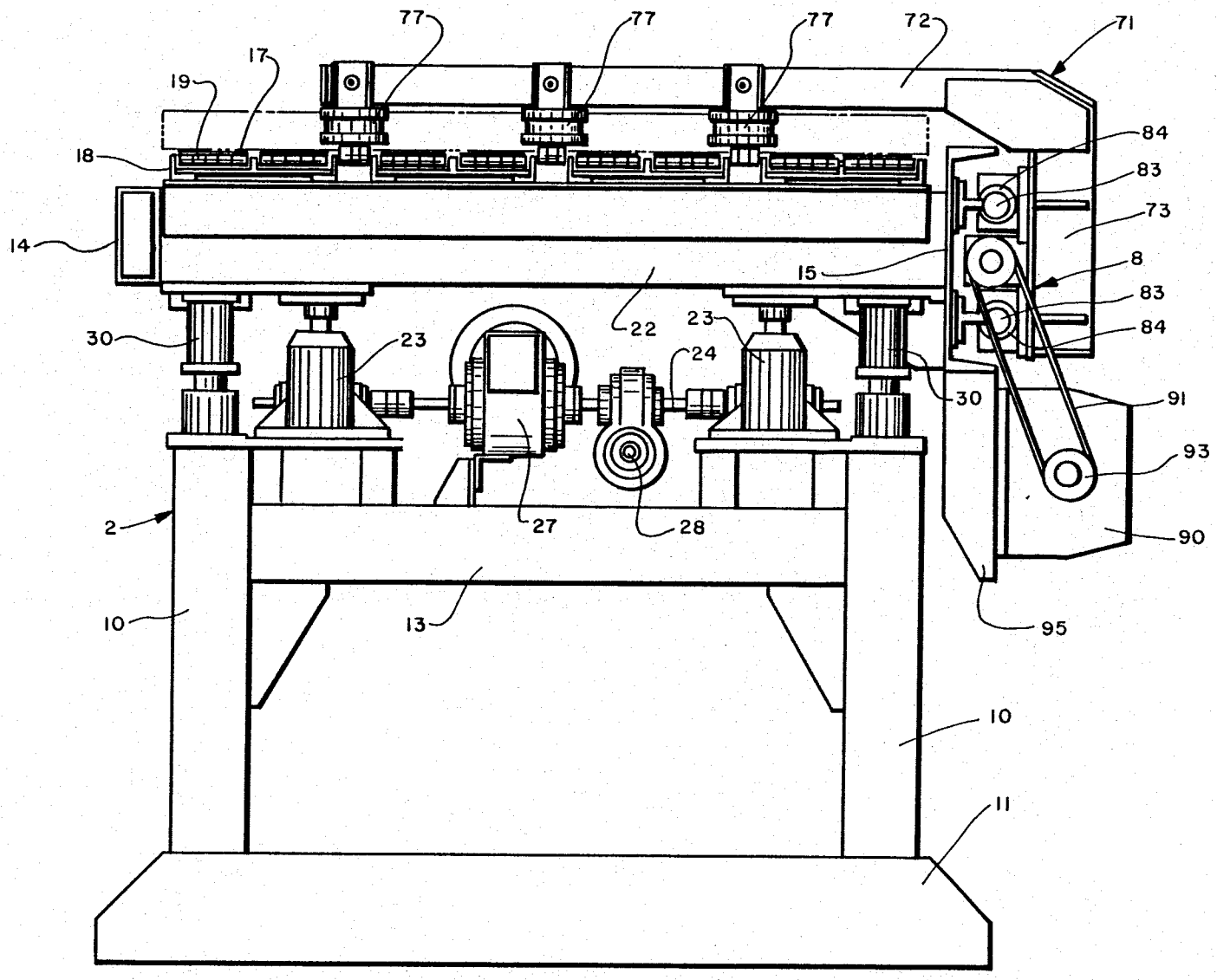
FIG. 6 is a rear elevational view of the apparatus looking in from the right-hand end of FIGS. 1 and 2.

Referring to FIGS. 1 and 6, table end channels 14 and 15 preferrably are connected by horizontal end cross members 22, each having a generally rectangular box-shaped cross sectional configuration on which table conveyor frames 18 are mounted. Cross members 22 are supported on vertical frame members 10 by a plurality of table adjusting jacks 23 which are operatively connected to each other by a transfer shaft 24 and a longitudinal shaft 25 for raising and lowering jacks 23 by a table adjustment motor 26. Motor 26 is operatively connected to the shafts through a worm gear speed reducer 27 and a shaft support and control device 28 (FIG. 6). Stablility for table cross members 22 is provided by four corner support bearings 30 which, in addition to jacks 23, mount the upper table frame on the vertical table base. Jacks 23 enable the vertical height of the coil supporting surface provided by conveyor belts 17 to be adjusted to accommodate different size exchanger coils and to assist the loading and unloading of a coil onto and off of the support table.

Figure 4:
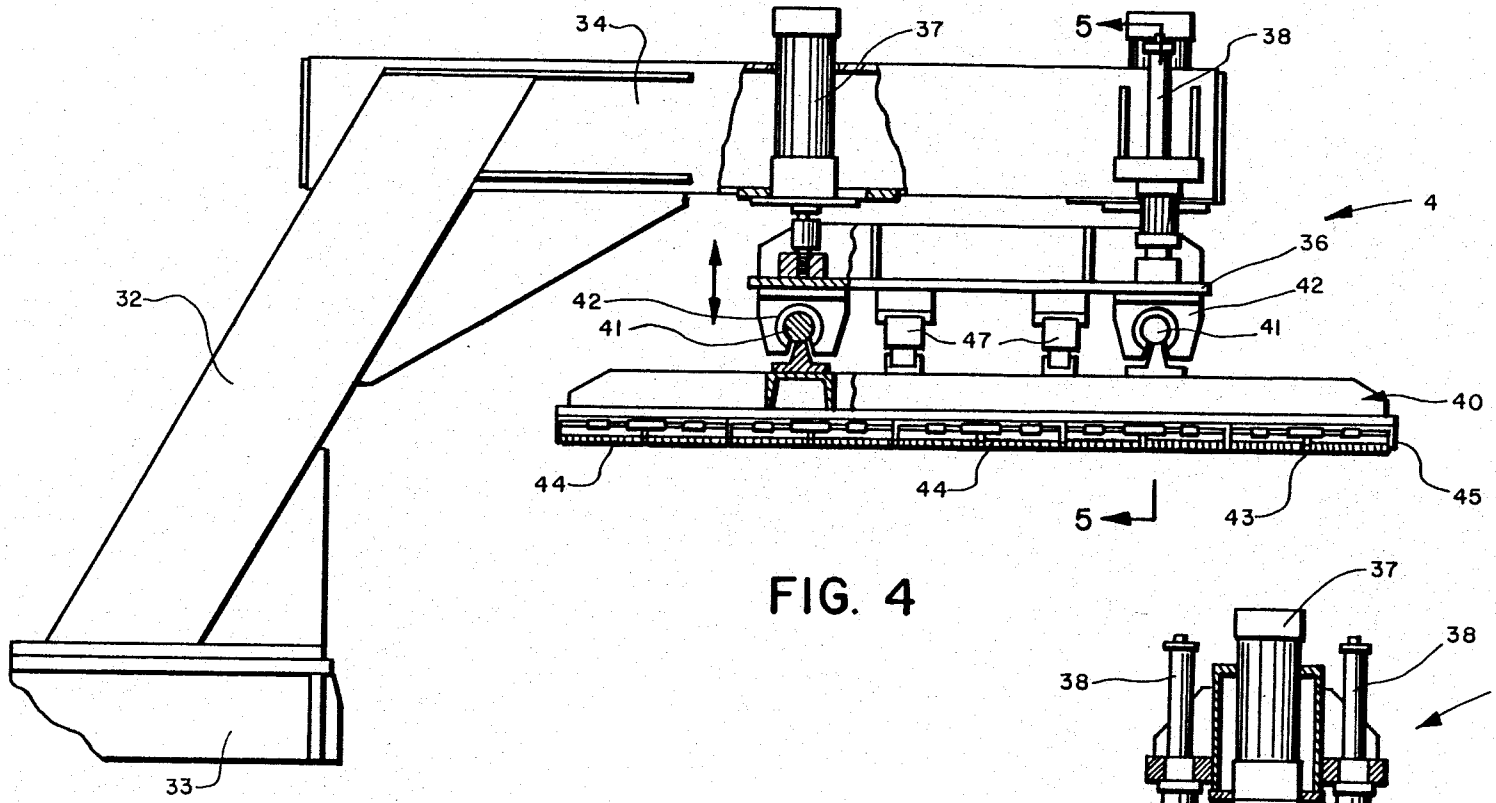
FIG. 4 is an enlarged, fragmentary sectional view taken on line 4—4, FIG. 1, with portions broken away, showing the hold-down assembly.
Figure 5:
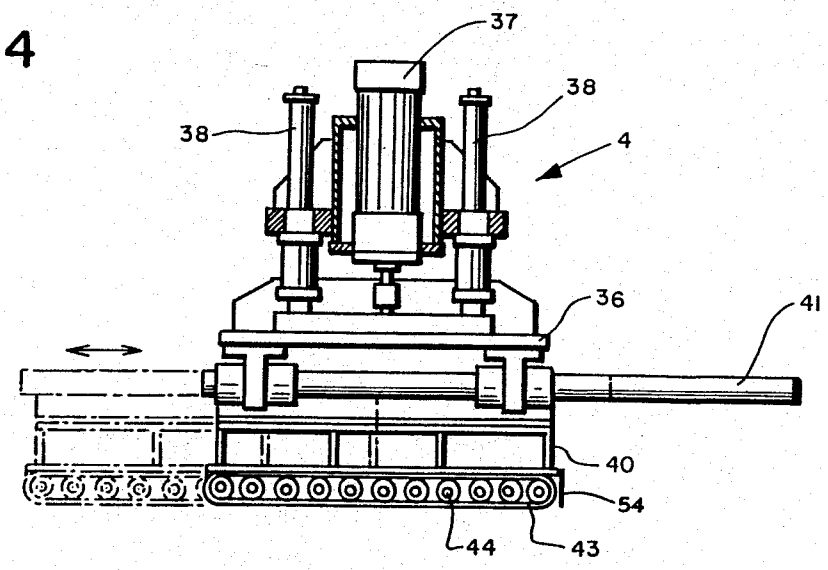
FIG. 5 is a fragmentary sectional view taken on line 5—5, FIG. 4.

Hold-down assembly 4 is best illustrated in FIGS. 2, 4 and 5. Hold-down assembly 4 includes a diagonally extending mounting channel 32 which extends upwardly from a main support frame indicated generally at 33. A cantilever support beam 34 extends horizontally outwardly from the top of mounting channel 32 above the front end and transversely across conveyor belts 17. Hold-down assembly 4 further includes a support plate 36 movably mounted beneath beam 34 by a plurality of air cylinders 37 and guide rod bearings 38 which are mounted on beam 34 and connected to support plate 36.

A hold-down conveyor indicated generally at 40, is longitudinally movably mounted beneath support plate 36 by a pair of guide rods 41 which are mounted in bearings 42 attached to the bottom of support plate 36. A plurality of conveyor belts 43 are supported by a plurality of free turning rollers 44 located within individual conveyor frames 45. Belts 43 extend in the longitudinal direction parallel with table conveyor belts 17. Hold-down conveyor 40 is freely slidably mounted on guide rods 41 for limited longitudinal movement above support table 2, with support plate 36 being firmly mounted in the longitudinal direction with respect to support table 2 and is movable only in the vertical direction by pressurized air cylinders 37 and guide rods 38. A plurality of return cylinders 47 with sensors are mounted between support plates 36 and hold-down conveyor 40 for longitudinal positioning of conveyor 40 with respect to plate 36.

Figure 3:
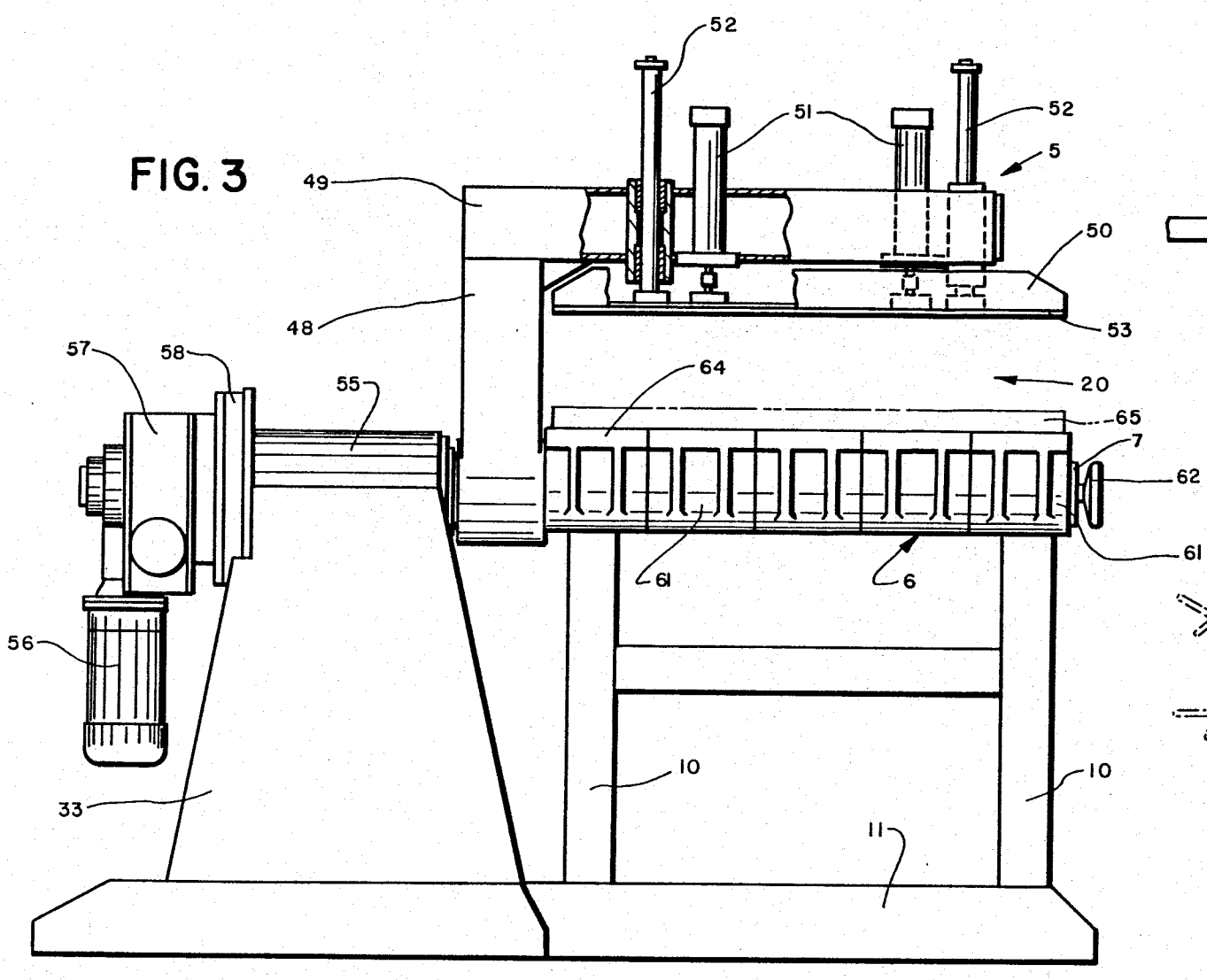
FIG. 3 is a generally diagrammatic view with portions broken away looking into the front end of the apparatus showing particularly the clamp and anvil assemblies mounted on the spindle.

Clamping pad assembly 5 is best illustrated in FIGS. 1, 2 and 3. Assembly 5 includes an angle mounting arm 48 which is fixed to spindle 7 for rotation therewith and extends upwardly from the spindle. A cantilever support beam 49 extends horizontally outwardly from the top of angle arm 48 transversely across support table 2. A clamp beam 50 is vertically movably mounted on support beam 49 by a plurality of air cylinders 51 and guide rods 52 for vertical raising and lowering clamp beam 50 with respect to the top surface of anvil 61 and support table conveyor 17. Preferably a urethane protective clamp pad 53 is mounted on the bottom surface of clamp beam 50 to prevent damaging the fins of a heat exchanger coil 65 and prevent slipping of the coil during bending.

Spindle 7 is rotatably mounted by a spindle bearing 55 on the top of main support frame 33. Spindle 7 is rotated in bearing 55 by a servo drive motor 56 (FIG. 3) through a speed reducer 57. Reducer 57 and motor 56 is mounted by a bracket 58 on main support frame 33.

Referring to FIGS. 1 and 3, anvil assembly 6 is formed by a plurality of anvil segments 61 which are mounted in an abutting relationship on spindle 7 for rotation therewith. Individual anvil segments 61 are slidably mounted on spindle 7 and retained thereon by a clamping wheel 62. As shown in FIG. 1, anvil segments 61 have a curved surface 63, the particular radius of which will determine the radius of the bend in the finned heat exchanger coil. Preferably a urethane protective pad 64 is mounted on the top surface of each segment 61 to protect the coil fins and prevent slipping of the coil during bending. Anvil assembly 6 and clamping pad assembly 5 are rigidly mounted on spindle 7 for rotation in unison therewith. Pad assembly 5 is immovable with respect to anvil 60, except for the vertical movement of clamping beam 50 for clamping heat exchanger coil 65 against the anvil.

In accordance with one of the main features of the invention, coil gripper assembly 3 is height adjustable and movably mounted for longitudinal movement along support table 2 by drive assembly 8. Gripper assembly 3 positively grips "U"-shaped tube ends 67 (FIG. 8) of coil 65 for moving coil 65 longitudinally along conveyor 17 on support table 2, and in particularly for applying an accurately controlled acceleration to the coils during the bending thereof as described in further detail below.

Figure 8:
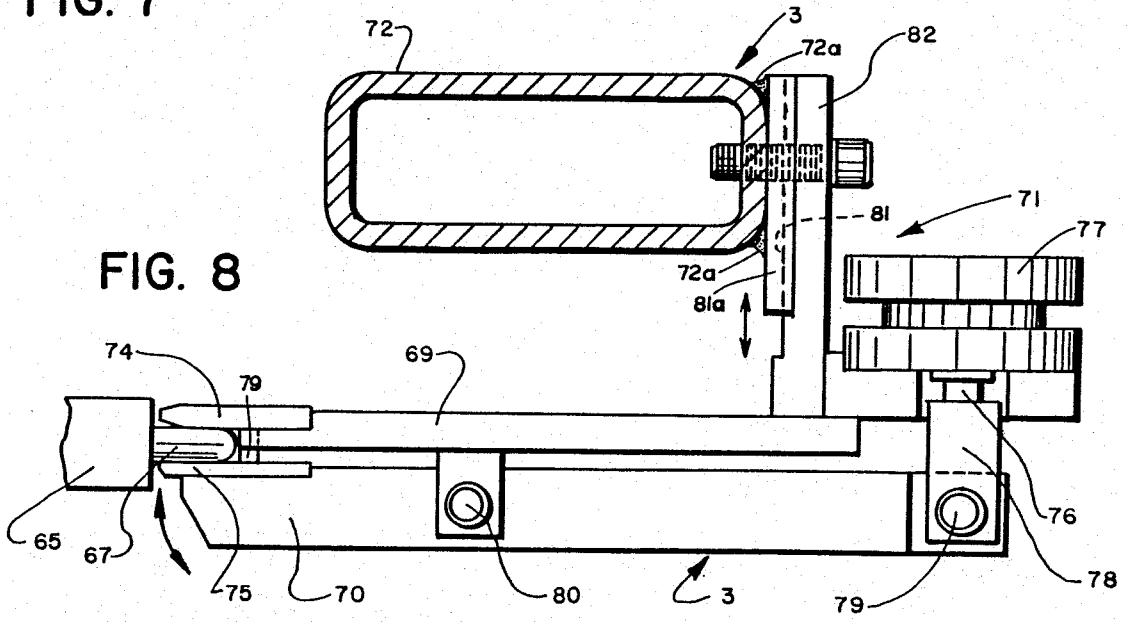
FIG. 8 is an enlarged fragmentary sectional view taken on line 8—8, FIG. 2, showing the gripper assembly and the mounting arrangement thereof.

Referring to FIG. 8, gripper assembly 3 includes a fixed and height adjustable upper gripper bar 69 and a pivotally mounted lower gripper lever 70, both of which are mounted on a carriage indicated generally at 71 (FIG. 6). Carriage 71 includes a cantilever support beam 72 and a cantilever beam support arm 73 (FIG. 6). A pair of gripper jaws 74 and 75 are mounted on the ends of bar 69 and lever 70, respectively, and extend transversely across conveyor 17 of support table 2 beneath cantilever beam 72 for gripping tube bends 67 therebetween. Pivotally mounted lever 70 is moved by a plurality of piston rods 76 of spaced double acting air or hydraulic cylinders 77. Each piston rod 76 is connected through a clevis 78 to a pivot pin 79 at the outer end of lever 70. Lever 70 is pivotally mounted on an intermediate pivot pin 80 and fixed upper bar 69 is attached to and vertically adjustable with respect to cantilever beam 70 by a vertically extending mounting plate 82 (FIG. 8) which slide within a channel 81 formed in a channel slide plate 81*a* which is attached by welds 72*a* to beam 72.

Figure 7:
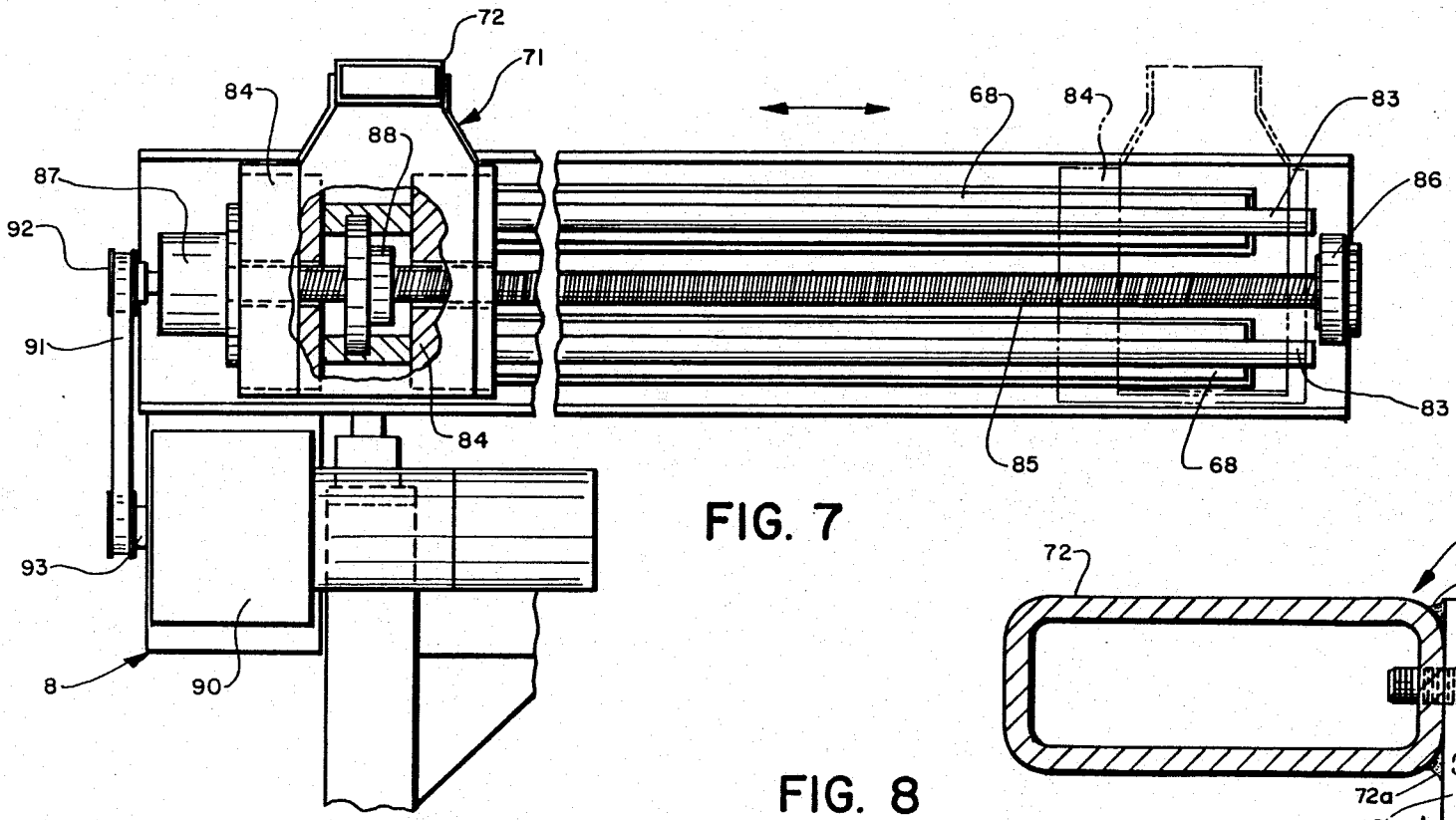
FIG. 7 is a fragmentary sectional side elevational view showing the drive mechanism for the gripper with the gripper carriage being shown in full lines at the left and in dot dash lines at the right.

Carriage 71, and in particular support arm 73 thereof, is movably mounted on a pair of guide rods 83 by linear ball pillow bearings 84 which are secured to cantilever beam support arm 73. Guide rods 83 are mounted on "U"-shaped mounting channel 15 by longitudinally extending support pads 68. A ball screw 85 extends longitudinally along the side of support table 2 parallel with and intermediate of rods 83 (FIG. 7). Ball screw 85 is mounted in a pair of end bearings 86 and 87 which are fixed on "U"-shaped channel 15. A ball screw nut 88 is operatively engaged with ball screw 85 and is secured to cantilever beam support arm 73 for moving carriage 71 longitudinally along the side of table 2 upon rotation of the ball screw. Ball screw 85 is connected to a servo drive motor 90 by a timing belt 91 which extends between a pair of pulleys 92 and 93 mounted on the end of ball screw 85 and the output shaft of servo motor 90, respectively. Servo motor 90 is mounted on a support plate 95 (FIG. 6) which is connected to "U"-shaped mounting channel 15 which also serves as the support for bearing shafts 83 and ball screw 85.

The operation of the improved coil bending apparatus and the steps of the improved method for bending a heat exchanger coil is set forth below.

A flat heat exchanger coil 65 (FIG. 1) is loaded onto conveyor belts 17 of support table 2 from the bend station end (left hand end of FIGS. 1 and 2) by use of a loading table 96 shown diagrammatically and in partial view in FIG. 2. A plurality of sensors 79 (FIG. 8) are mounted between upper bar 69 and lever 70 of coil gripper assembly 3 which has moved to the forward end of table 2 below hold-down assembly 4 and are actuated upon contact with tube end 67 to actuate air cylinders 77 pivotally moving lever 70 into clamping engagement with tube ends 67. Actuation of gripper drive assembly 8 and in particular gripper drive motor 90, will move coil gripper assembly 3 through the rotation of ball screw 85, from the left-hand side of FIG. 1 below hold-down assembly 4 to the start position as shown at the right side of FIG. 1. Conveyor belts 17 and their mounting frames which form the coil support surface are moved vertically above the top of anvil segments 61 by table adjusting jacks 23 after loading of coil 65 thereon to prevent fin damage as coil 65 is moved rearwardly by gripper assembly 3 to the first bend position. The table is lowered prior to coil 65 starting its forward movement.

Assuming in FIG. 1 that coil 65 as shown in solid lines, is in position for a first bend which when completed is shown at 98 in the dot-dash representation of a formed coil. Air cylindlers 51 of clamp pad assembly 5 are then actuated bringing clamping pad 53 into pressure engagement with the coil pressing it against anvil assembly 6 hold-down assembly 4 will be actuated and in particular air cylinders 37 thereof, to lower hold-down conveyor 40 into contact with coil 65 as shown in dot dash lines. Next the appropriate controls then are actuated energizing servo motor 56 rotating spindle 7 together with attached anvil assembly 6 and clamp pad assembly 5 bending the coil about arcuate curved surfaces 63 of anvil segment 61 forming the bend therein. Preferably spindle 7 will be rotated throughout an angle of approximately 90° to 100° permitting the coil to move or spring back to an approximately 90° final bend upon releasing of the clamping action exerted thereon by clamping pad 53. Drive motor 90 of gripper assembly 3 then advances coil 65 forwardly while simultaneously spindle 7 and coil clamp pad assembly 5 return to a top position as shown in FIG. 1 until the next bend area indicated at 99, is located above spindle 7 on anvil 6. Conveyor 40 of hold-down assembly 4 will remain in its lowered coil contacting position during the continued forward movement of coil 65. Upon coil bend section 99 arriving at spindle 7 or bending station 20, clamping pad 53 is then lowered into clamping engagement with the coil followed by the rotation of spindle 7 by servo drive motor 56 putting a second bend in the coil indicated at 99, FIG. 1.

Gripper assembly 3 continues to advance coil 65 to the final bend forming position at which position the front end of the gripper assembly will engage a strike plate 54 mounted on hold-down conveyor 40 (FIG. 5). Continued forward movement of gripper assembly 3 will move conveyor 40 with guide rods 41 to a position which places conveyor 40 directly above anvil segments 61 and into contact with the remaining portion of coil 65 which is located at anvil segments 61 for the final bend formation.

Coil gripper assembly 3 as shown in FIG. 1 is in its fully retracted or start position with hold-down assembly 4 being shown in dot dash lines at its normal position for forming the first three bends prior to being moved forward by contact with striker plate 54 of coil gripper assembly 3. These components are shown in the full line position of FIGS. 1 and 2 for the sake of clarity. Cylinder 47 (FIG. 4) will return hold-down conveyor 40 of assembly 4 from its forwardmost position above anvil segments 61 to its usual rest position until contacted again by cantilever beam 72 of gripper assembly 3 against striker plate 54. In accordance with the main feature of the invention, during each bending movement of spindle 7, including anvil 6 and clamping pad 53, the forward longitudinal movement of gripper assembly 3 is accelerated by drive motor 90 and ball screw 85 at a greater rate than the rotational accelerated speed of spindle 7 to crowd additional coil material into the bend zone. It has been determined that this accelerated, coordinated movement which is achieved by applying an axial force on the rear of coil 65 at a greater accelerated rate than the rotational acceleration rate of spindle 7 results in a bend with less fin deformation or distortion than would occur if a constant axial force or pressure is exerted on the rear of coil 65 during the bending operation as in the prior art device described in the Background Art portion of the specification. Likewise, it has been determined that such fin distortion will also occur if no force is applied in the axial direction on coil 65 during exertion of the bending force on the coil exerted by the rotating spindle.

Gripper assembly 3 and in particular the drive mechanism therefor, provides for the controlled accelerated feed rate of coil 65 in relationship to the radial speed of spindle 7. The gripper and spindle axes are coordinated to both move in unison and accelerate together but at different speeds to arrive at final end points at the same time. The acceleration of gripper assembly 3 which can be expressed as the movement of a linear axis is greater the rotational speed or movement expressed by a radial axis in order to provide the crowding of the material into the bend which has been determined to provide the desired results of the invention. This coordinated movement is diagrammatically illustrated in FIGS. 9 and 10.

Figure 9:
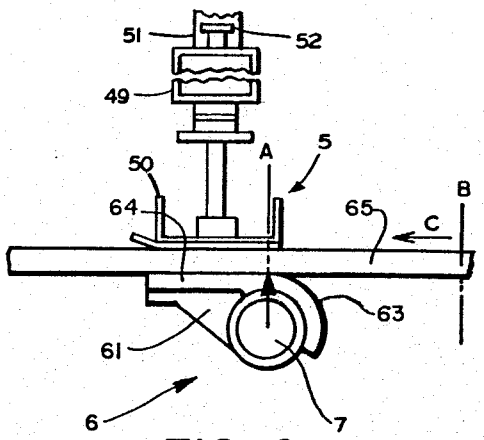
FIGS. 9 and 10 are diagrammatic views showing the movement of a section of coil during the formation of a single bend therein.
Figure 10:
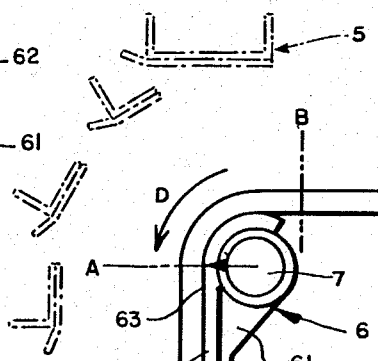

A radial axis or reference point A is shown in FIG. 9 at the start of a bend in relationship to a linear axis or reference point B. Upon completion of the bend (FIG. 10) the two axes or points have reached the positions shown in FIG. 10. In order for points A and B to reach the end points of FIG. 10 at the same time the movement of linear axis B in the direction of arrow C is accelerated faster than the acceleration of point A by the rotation of spindle 7 when rotating in the direction of arrow D. This provides for the crowding of coil material toward the bend while providing the arrival at points A and B at their final position in FIG. 10 upon completion of the bend at the same time, even though the two reference points, or axes, are being accelerated at different rates. Upon completion of either one, two or three bends in coil 65, the formed coil is removed by an automatic coil unloading mechanism 102 shown partially in FIG. 2 forms no particular part of the invention.

The coordinated movement of the speed of rotation of spindle 7 by servo drive motor 56 with the linear movement of gripper assembly 3 by drive motor 90, preferably is automatically controlled by a computer control mechanism located within a control cabinet 103 located adjacent to the coil bending apparatus 1. Various controls in cabinet 103 are also connected by appropriate control circuits, electronic, hydraulic and/or pneumatic with the various pressurized control cylinders 51 of clamp assembly 5 and cylinders 37 of hold-down assembly 4, as well as the drive motor for table adjustment jacks 23. Such control circuits are well known in the art and, therefore, are not shown in detail. Anyone skilled in the art can develop a variety of control circuits interconnecting the various components discussed above for achieving the interrelationship and coordinated movement of the parts. Furthermore, the movement of the various components and in particular the coordinated movement of the gripper assembly with the rotational movement of spindle 7 preferably is programmable whereby different coil densities and configurations can be bent on apparatus 1 by changing the control program for controlling the movement of gripper assembly 3 and spindle 7 as well as the other control cylinders.

Improved apparatus 1 and the method achieved thereby has a number of features and advantages. For example, if desired, anvil segment 61 can be replaced with different configured segments to achieve various radii of angular bends and to accommodate coils of different fin densities and sizes. Also, upon the completion of each bend, clamp pad assembly 5 will move upwardly to the unclamped position followed by the rotation of spindle 7 from the 90 degree position back to the zero degree position. Simultaneously with this return rotation of spindle 7, gripper assembly 3 will move the coil forward for the next bend position. Hold-down assembly 4 is moved forward by gripper assembly 3 when forming the final bend so as to maintain the remaining portion of the coil as close as possible to the table to prevent it from raising upwardly as occurs in prior coil bending machines. The conveyor belts of hold-down assembly 40 are mounted on free-wheeling rollers which permit the coil to slide easily forwardly during bending by the accelerated movement of gripper assembly 3 and the rotational movement of spindle 7. If desired, support table 2 may be elevated during loading of a coil thereon to prevent the coil fins from rubbing across the anvil.

Figure 11:
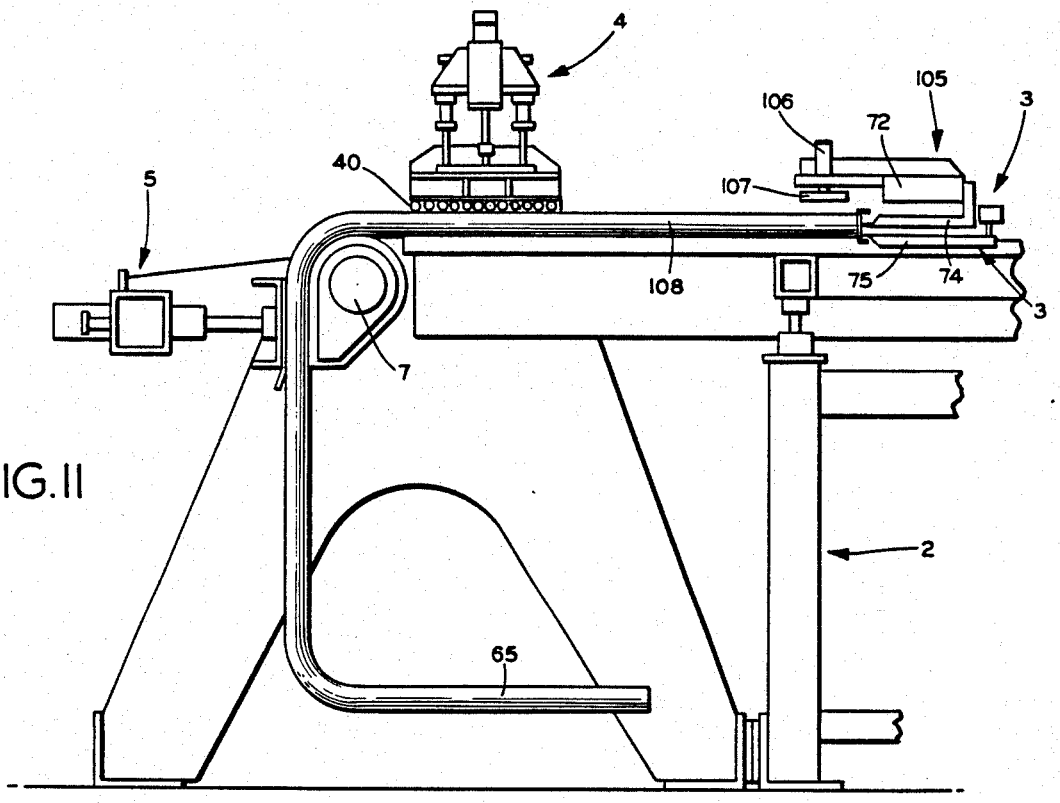
FIGS. 11 and 12 are diagrammatic side elevational views showing a modification to the coil bending apparatus in which an auxiliary hold-down assembly is mounted on the gripper assembly.
Figure 12:
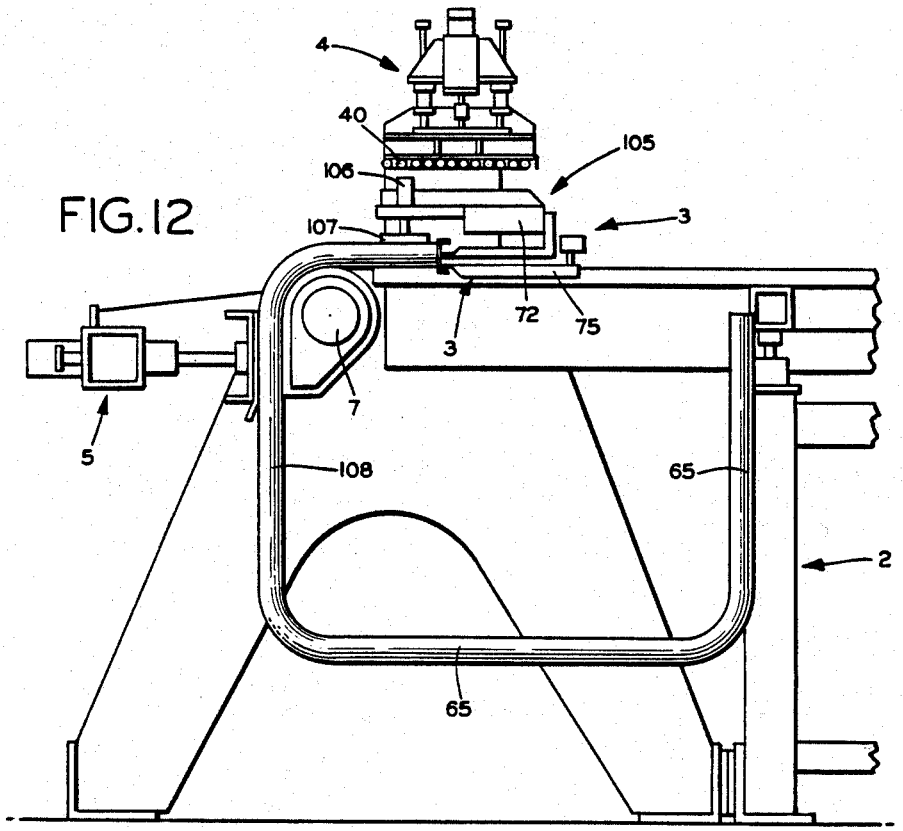

A modification to the improved coil bending apparatus is shown particularly in FIGS. 11 and 12. An auxiliary hold-down assembly 105 is mounted on coil gripper assembly 3, preferably on cantilever beam 72 thereof, and extends outwardly and forwardly so as to be located just forward and above coil tube end gripper jaws 74 and 75. Auxiliary hold-down assembly 105 will include a plurality of pressure cylinders 106 for raising and lowering a hold-down or clamp pad 107 which is similar in certain respects to hold-down conveyor 40 of main hold-down assembly 4. Cylinder 106 and pad 107 will move in unison with gripper assembly 3 as it moves along support table 2 toward the bend station. As shown in FIG. 11 hold-down pad 107 will normally be in a raised position out of engagement with a coil gripped by coil gripper assembly 3 as the first three bends are being made in a heat exchanger coil 65. When the short leg of a coil 108 is being bent by the improved mechanism, auxiliary hold-down assembly 105 will be used with hold-down pad 107 being lowered into engagement with coil 108 by cylinders 106 as shown in FIG. 12. Main hold-down conveyor 40 will be placed in the raised position permitting passage of auxiliary hold-down assembly 105 beneath it to a forwardmost position as shown in FIG. 12 for engaging the rearmost end of coil 108 as the bend is being performed thereon by spindle 7 and main clamp pad assembly 5. Auxiliary hold-down assembly 105 enables main hold-down assembly 4 to be fixed in a longitudinal position, that is, it need not be mounted on guide rods 41 for linear movement as described above and shown particularly in FIGS. 1, 4 and 5. This reduces the cost of the apparatus and allows bending of extremely short legs. It modifies slightly the sequence of operation thereof without effecting the desired results. The mode of operation of moving coil 108 and imparting the bends therein is similar to that described above for main coil bending apparatus 1.

Figure 15:
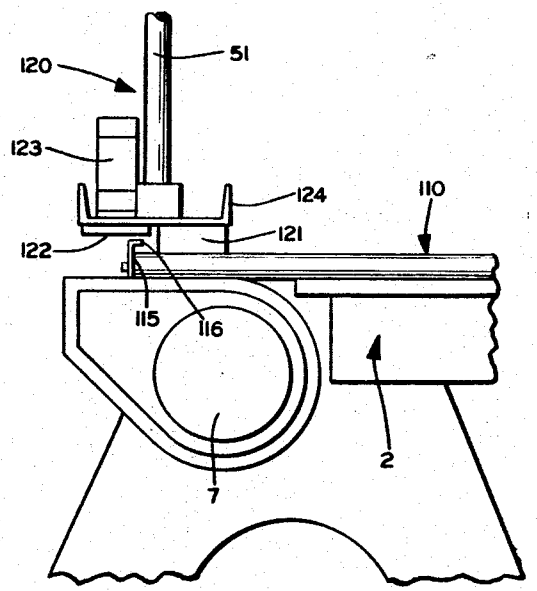
FIG. 15 is a diagrammatic side elevational view similar to FIG. 14 showing the modified apparatus forming a short bend leg in a coil as shown in FIG. 13.
Figure 14:
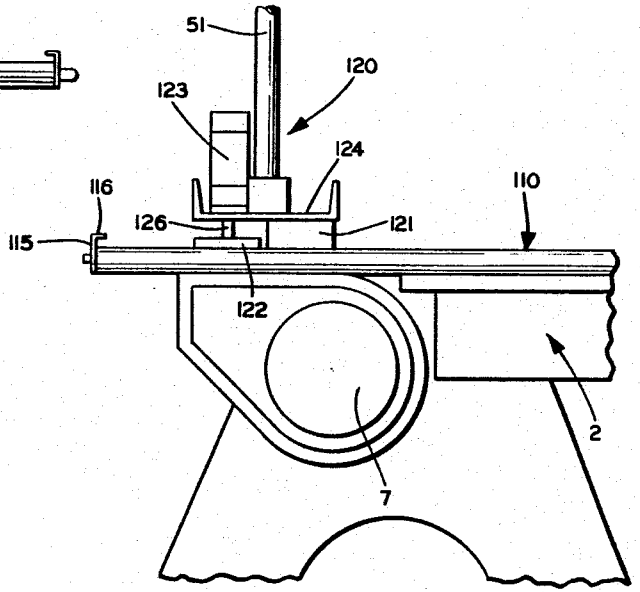
FIG. 14 is a diagrammatic side elevational view showing another modification to the coil bending apparatus.
Figure 13:
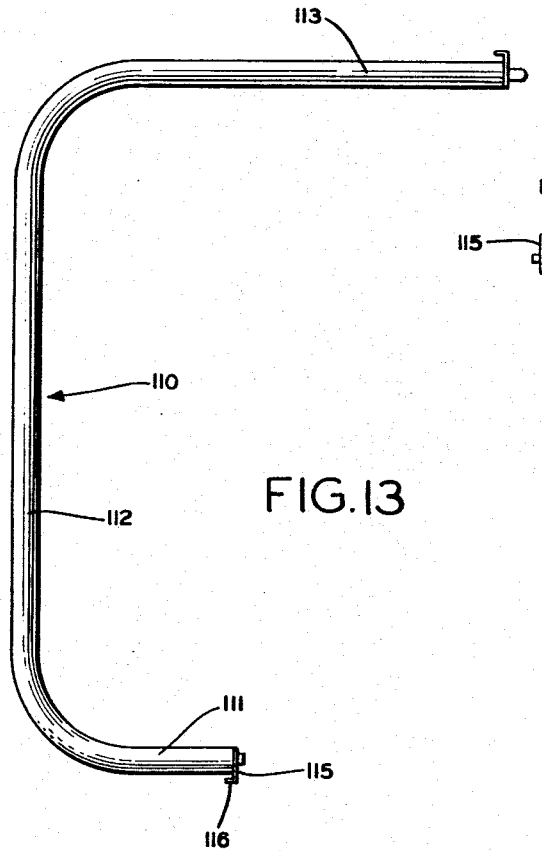
FIG. 13 is a plan view of a modified form of a heat exchanger coil having a short bend leg formed thereon.

A further modification to the improved coil bending apparatus of the invention is shown in FIGS. 13–15. A different heat exchanger coil configuration is shown in FIG. 13 and is indicated generally at 110. Coil 110 is formed with at least one relatively short leg bend 111 in combination with two longer legs 112 and 113. Problems can occur during the formation of short leg bend 111 when using clamp pad assembly 5 as described above due to the size of clamp pad 53 thereof. The longitudinal width of clamp pad 53 must be sufficiently long in forming the normal bend legs in a heat exchanger coil as shown in FIG. 1 to prevent creasing or damaging the coil. However this width of the clamp pad is unsatisfactory when forming a short leg bend 111 especially when the bend is formed at the front end of the coil which has a front header plate 115 mounted thereon with an upstanding flange 116, which construction is present in many heat exchanger coils. In attempting to form short leg bend 111, clamp pad 53 would contact flange 116 damaging the coil and preventing the formation of the short leg bend therein.

Therefore to enable the improved apparatus of the invention to be used in the formation of a short leg bend 111 at the front end of a coil, a modified clamp assembly indicated generally at 120, is incorporated into the above described bending apparatus. Modified clamp assembly 120 includes a clamp beam 124 which is similar to clamp beam 50 as described above which is moved vertically by air cylinders 51. A fixed clamping pad 121 is securely mounted on the bottom of clamp beam 124, as shown in FIGS. 14 and 15. Pad 121 preferably is formed of a polyurethane or firm rubber so as to prevent damage to the coil fins. A retractable pad 122 is movably mounted on the forward end of clamp beam 124 by a pneumatic cylinder 123. Cylinder 123 preferably is mounted on an upper surface of clamp beam 124 having a piston rod 126 extending through an opening (not shown) formed in beam 124. Retractable pad 122 is mounted on the extended end of piston rod 126 and is vertically movable between a coil engaging position as shown in FIG. 14, to a raised retracted nonengaging position as shown in FIG. 15.

When modified clamp assembly 120 is used for forming a usual length bend or coil leg as described above with respect to coil 65, pad 122 will be lowered, as shown in FIG. 14, so that its bottom surface is aligned with the bottom surface of fixed pad 121. These two surfaces combine to form the clamp down surface of the pad which engages coil 110 with clamping pads 121 and 122 performing in the same manner as that of clamp pad 53 of clamping pad assembly 5 described above. However, when a front short leg bend 111 is being formed, as shown in FIG. 15, retractable pad 122 is raised by pneumatic cylinder 123 to the position shown in FIG. 15 permitting front flange 116 to pass beneath pad 122 with fixed pad 121 providing the clamping engagement between the modified clamping pad and the heat exchange coil. The longitudinal length of fixed pad 121 is sufficient to form short leg bend 111 whereas the combined longitudinal lengths of pads 121 and 122 provide the desired longitudinal length for forming a usual coil bend leg in the heat exchange coil such as legs 112 and 113 (FIG. 13).

The remaining components of the improved coil bending apparatus and its method of operation remain generally the same as that described above when modified clamping pads 121 and 122 replaces fixed clamping pad 53.

Accordingly, the improved apparatus and method provides for coordinated movement between the linear and rotational movement of the coil during the bending operation with the linear movement being at an accelerated speed greater than the acceleration speed of the rotational movement to reduce fin damage during bending. Thus, it is the coordinated movement of both the bending anvil and the positive linear feed of the coil in unison and associated acceleration whereby a radial axis of the coil bend will arrive at a desired point at the same time as does a linear axis on the coil.

Accordingly, the improved heat exchanger coil bending apparatus and method is simplified, provides an effective, safe, inexpensive, and efficient device and method steps which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved heat exchanger coil bending apparatus and method is constructed and used, the characteristics of the construction and method steps, and the advantageous, new and useful results obtained; the new and useful structures, devices, elements, arrangements, parts and combinations, and method steps and procedures, are set forth in the appended claims.

What is claimed is:

1. Apparatus for bending a heat exchanger coil having fins to a predetermined angle at a bending station including:

(a) table means for supporting a coil during linear movement of said coil toward the bending station;

(b) gripper means engagable with the coil for advancing said coil linearly forwardly along the table means;

(c) hold-down means engagable with the coil adjacent the bending station for maintaining a portion of the coil located rearward of the bending station against the table means during bending of a forward portion of said coil;

(d) bending means engagable with the coil at the bending station for bending the coil to a predetermined angle;

(e) first drive means for rotating the bending means through a predetermined angle for bending the coil and (f) second drive means engagable with the gripper means for accelerating the gripper means and engaged coil linearly along the table means at a controlled rate in unison with rotational acceleration of the bending means, with the rate of linear acceleration of the coil by the second drive means being greater than the rate of rotational acceleration of the bending means and coordinated therewith whereby a radial axis of the bending means arrives at a final predetermined end point at the same time as does a linear axis on the coil to reduce distortion to the fins of the coil by crowding material into the bend.

2. The apparatus defined in claim 1 in which the table means includes a free-wheeling horizontal conveyor.

3. The apparatus defined in claim 2 in which the conveyor includes a plurality of belts each movably supported on a plurality of free rotating rollers.

4. The apparatus defined in claim 1 in which the gripper means includes a pair of spaced gripper jaws adapted to grip end tubes of the coil therebetween.

5. The apparatus defined in claim 4 in which the gripper jaws are mounted on a carriage which is movably supported on guide rods; and in which the carriage is moved linearly along the table means on the guide rods by the second drive means.

6. The apparatus defined in claim 5 in which one of the grippers jaws is fixed and the other of said gripper jaws is pivotally mounted for gripping the end tubes between said jaws.

7. The apparatus defined in claim 6 in which the pivotally mounted gripper jaw is moved into gripping engagement with the end tubes by a pressure device.

8. The apparatus defined in claim 5 in which the second drive means includes a ball screw extending along the guide rods and operatively connected to the carriage, and a drive motor for rotating said ball screw.

9. The apparatus defined in claim 1 in which the gripper means engages the hold-down means upon said gripper means reaching the bending station linearly moving the hold-down means along the table means to a final bend position at the bending station.

10. The apparatus defined in claim 9 in which the hold-down means includes a support plate mounted for vertical movement with respect to the table means and a hold-down conveyor mounted for horizontal movement on guide rods supported by said support plate.

11. The apparatus defined in claim 1 in which the bending means includes a clamp pad and an anvil, said clamp pad being movably mounted for clamping a coil against the anvil; and in which the clamp pad and anvil are mounted for rotational movement on a spindle for bending the clamped coil to a variable predetermined angle.

12. The apparatus defined in claim 1 in which the acceleration of the linear advancement of the gripper means and rotation of the bending means by their associated drive means is coordinated by a programmable control means.

13. A method of bending a heat exchanger coil having fins to a predetermined angle including the steps of (a) advancing the coil generally horizontally linearly along a support surface toward a bend station;

(b) clamping a first portion of the coil against an anvil immediately adjacent to and forward of a second portion to be bent at the bending station;

(c) holding a third portion of the coil rearward of the first portion from upward movement from the support surface;

(d) rotating the anvil through a predetermined angle while the first portion of the coil remains clamped against the anvil and the third portion held against upward movement from the support surface to bend the second portion of the coil; and (e) accelerating the liner advancement of the coil along the support surface at a controlled rate in unison with the rotational acceleration of the anvil with the rate of linear acceleration being greater than the rate of rotational acceleration and coordinated therewith whereby a radial axis of the coil bend arrives at a final predetermined end point at the same time as does a linear axis on the coil to reduce distortion to the fins of the coil.

14. The method defined in claim 13 in which an axial force is applied to a rear end of the coil for variably accelerating the coil linearly during the rotation of the anvil.

15. The method defined in claim 14 including gripping the rear end of the coil as it is being advanced along the support surface.

16. Apparatus for bending a heat exchanger coil to a predetermined angle at a bending station including:

(a) table means for supporting a coil during linear movement of said coil toward the bending station;

(b) gripper means engageable with the coil for advancing said coil linearly forwardly along the table means;

(c) hold-down means engageable with the coil adjacent the bending station for maintaining a portion of the coil located rearward of the bending station against the table means during bending of a forward portion of said coil;

(d) bending means engageable with the coil at the bending station for bending the coil to a predetermined angle, said bending means having an anvil and a movable clamp pad assembly having first and second pads, said first pad being adapted to clamp a portion of the coil against the anvil during the bending of the coil with said second pad being moveably mounted on the movable clamp pad assembly for selectively clamping another portion of the coil against said anvil; and (e) drive means for rotating the bending means through a predetermined angle for bending the coil as the coil is advanced linearly along the table means.

17. The apparatus defined in claim 16 in which the movable clamp pad assembly includes a mounting plate; and in which the first and second pads are mounted on said mounting plates.

18. The apparatus defined in claim 17 in which the second pad includes a pressure actuated cylinder attached to the mounting plate for selectively clamping said second pad against said anvil.

19. The apparatus defined in claim 18 in which the mounting plate includes top and bottom surfaces; in which the first pad is mounted on the bottom surface of the mounting plate; in which the pressure actuated cylinder is mounted on the top surface of the plate having a piston rod which extends through an opening formed in the plate to movably mount the second pad beneath the plate.

20. The apparatus defined in claim 16 in which each of the pads have bottom surfaces; and in which said surfaces are in alignment when the second pad is in a lowered position.

21. Apparatus for bending a heat exchanger coil to a predetermined angle at a bending station including:

(a) table means for supporting a coil during linear movement of said coil towards the bending station;

(b) gripper means engageable with the coil for advancing said coil linearly forwardly along the table means;

(c) hold-down means engageable with the coil adjacent the bending station for maintaining a portion of the coil located rearward of the bending station against the table means during bending of a forward portion of said coil, said hold-down means having a clamp pad mounted for vertical movement on the gripper means and extending forwardly from said gripper means;

(d) bending means engageable with the coil at the bending station for bending the coil to a predetermined angle; and (e) drive means for rotating the bending means through a predetermined angle for bending the coil.

22. Apparatus for bending a heat exchanger coil to a predetermined angle at a bending station including:

(a) a table means for supporting a coil during linear movement of said coil toward the bending station;

(b) gripper means engagable with the coil for advancing said coil linearly forwardly along the table means;

(c) hold-down means engagable with the coil adjacent the bending station for maintaining a portion of the coil located rearward of the bending station against the table means during bending of a forward portion of said coil, said hold-down means having a clamp pad mounted for vertical movement in the gripper means and extending forwardly from said gripper means;

(d) bending means engagable with the coil at the bending station for bending the coil to a predetermined angle;

(e) first drive means for rotating the bending means through a predetermined angle for bending the coil; and (f) second drive means engagable with the gripper means for accelerating the gripper means and engaged coil linearly in coordination with the rotation of the bending means during bending of the coil by said bending means to reduce distortion of the coil by crowding material into the bend.

* * * * *